United States Patent [19]

King

[11] 3,996,435

[45] Dec. 7, 1976

[54] ELECTRICAL SWITCH CONSTRUCTION

[75] Inventor: Albert King, Rietheim, Germany

[73] Assignee: Firma J. & J. Marquardt, Germany

[22] Filed: Oct. 10, 1975

[21] Appl. No.: 621,592

[30] Foreign Application Priority Data

Oct. 16, 1974 Germany ..... 2449120

[52] U.S. Cl. ..... 200/67 B

[51] Int. Cl.[2] ..... H01H 13/28

[58] Field of Search ..... 200/67 R, 67 B

[56] References Cited

UNITED STATES PATENTS 3,317,688 5/1967 Cherry et al. ..... 200/67 B

FOREIGN PATENTS OR APPLICATIONS 1,235,404 10/1964 Germany ..... 200/67 B

*Primary Examiner*—David Smith, Jr.
*Attorney, Agent, or Firm*—McGlew and Tuttle

[57] ABSTRACT

A switch comprises a housing with first and second spaced apart stop members with at least one of them being an electrical contact. A current carrying contact is mounted in the housing so as to project outwardly for connection to an electrical circuit and to extend upwardly inside a cavity of the housing. A two armed swivel member is pivoted over the current carrying contact and a movable contact portion is pivoted on the one arm of the swivel and it has an outer end which is oriented between the two stop members for engagement with a selective one in each operative position. The opposite arm of the swivel member is engaged by a lever which is pivoted in the housing and which is movable by a push button to actuate the switch. The spring is engaged with the movable contact and an extension of the lever member so that in an actuated position it is biased by the spring into engagement with one of the stop members. Displacement of the lever member by either a push button or a rotary actuator causes the movement of the spring through the pivot position of the movable contact and then a snapping of the switch into a second position against the opposite one of the stop members or contacts.

10 Claims, 2 Drawing Figures

FIG. 1
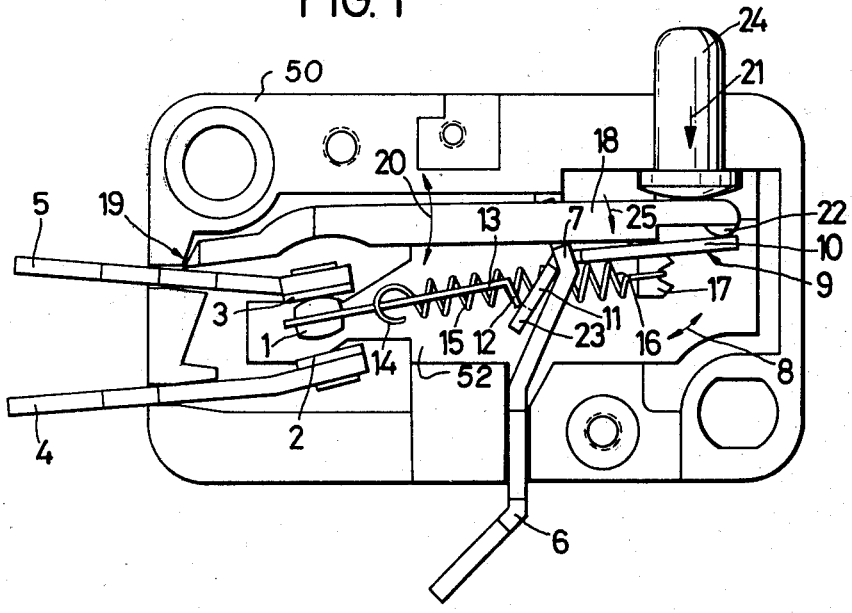
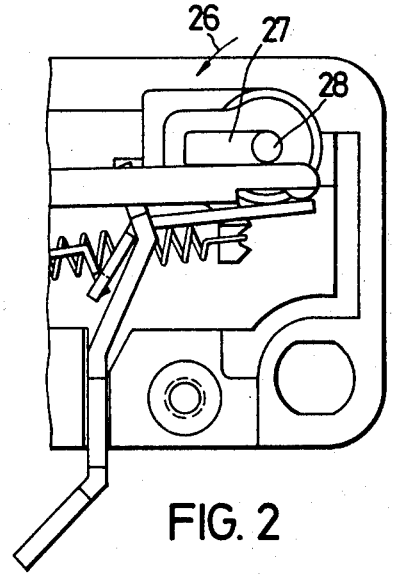
FIG. 2

ELECTRICAL SWITCH CONSTRUCTION

BACKGROUND OF THE INVENTION

1. FIELD OF THE INVENTION

This invention relates in general to the construction of electrical switches and in particular to a new and useful electrical switch which includes a contact arm which is pivotally mounted for pivoting on a swivel member and which is connected through a tension spring to an operating lever which may be moved in order to actuate the switch by moving the spring through the pivot position to cause the movable contact to snap into an actuated position.

2. DESCRIPTION OF THE PRIOR ART

The present invention relates in particular to an electrical switch which comprises a contact arm which is mounted for pivoting on a swivel member to which one end of a tension spring is secured at a location spaced from the pivot bearing thereof and whose other end is retained by an actuatable pivoting lever, with the contact arm being pivotable between two stops of which at least one is a fixed contact. An electrical switch of this kind is known but the known construction includes a pivoting lever and a swivel member which are pivoted directly on the actuating member and this requires an arrangement which necessarily leads to a relatively voluminous switch housing.

SUMMARY OF THE INVENTION

The present invention is an improvement over the prior art inasmuch as it provides a simple switch of inexpensive and uncomplicated and durable construction. The switch is designed so that the swivel member rests against the pivoting lever. Thus it is sufficient to actuate the pivoting lever which in turn will rotate the swivel member. This makes it possible to arrange the pivoting lever so that the desired rugged construction of the switch may be obtained. Preferably the swivel member is designed as a two arm lever and its one arm is associated with the pivoting lever while the other arm is associated with the contact arm. If, for example, the first lever arm is pivoted downwardly, the other lever arm which is coupled to the contact arm through a pivot bearing travels in a corresponding amount upwardly. For particular purposes the two lever arms may also be designed with unequal lengths.

In a particular preferred embodiment of the invention the pivoting lever extends substantially parallel to both the contact arm and the swivel member, and the swivel member is at least in the initial position of the two parts approximately aligned with the contact arm in the longitudinal direction. By providing the pivoting lever in a length which is not longer than the swivel member or is only slightly longer than the swivel member along with the contact arm and by disposing them as close to each other as possible, a particularly rugged construction is obtained. In an advantageous manner the pivoting lever, the swivel member and contact arm are all mounted in knife edge bearings.

According to a further variation of the invention, the contact arm, the swivel member, the pivoting lever and the tension spring constitute a snap mechanism in which the pivot bearings forming the joint between the contact arm and the swivel member is pivotable transversely to the line of action of the tension spring. It is brought into a position at the one or the other side of the line of action in dependence on the position of the switch. The swivel member and the contact arm form a toggle lever construction. As soon as the toggle joint connecting the two parts is pivoted across the line of action of the tension spring, upon passing the stable position, the joint reverses abruptly. As is well known, in the unstable position the tension of the tension spring is at its maximum. The pivoting of the toggle joint across the line of action of the spring can be obtained either by bringing the joint into a straightened positioned and moving it beyond the line of action or, with the simultaneous straightening of the joint, by pivoting the spring so as to move its line of action beyond the toggle joint. The two movements may also be provided simultaneously, in which case, the directions of motion are opposite to each other. Advantageously the tension spring is secured to an extension of the pivoting lever projecting laterally therefrom approximately in the direction of the actuation of the switch. This makes it possible to obtain an at least substantially parallel arrangement of the pivoting lever and the tension spring and it also contributes to the rugged construction.

According to another feature of the invention the structural element on which the swivel member is mounted is electrically conducting and is connected to or integral with a current carrying connection element of the switch in an electrically conducting manner. The swivel member as well as the contact arm are also designed as conducting parts. Thus the current flows from the connection element, for example a soldering lug or a terminal, through the structural element supporting the swivel member and further through the mobile contact to the fixed contact and therefrom to another connection element. The switch may be designed both as a double throw switch and as an off-on switch. In this connection it is very advantageous to provide each switching mechanism with two fixed contacts which alternately cooperate with the movable contact and to make the mechanism usable as a double throw switch.

In accordance with another feature of this invention the switch comprises a monostable design. A shiftable actuating member is provided which acts on the pivot lever at the side which is opposite to the swivel member relative to the lever member. The end portion of the actuating member projecting from the housing of the switch is preferably pushed by hand. A special return spring for the actuating member becomes superfluous if the switching mechanism is monostable. In this latter case in the absence of an actuating force the mechanism pushes the member back into the initial position.

The switch may advantageously be actuated either by a pushbutton or rotary cam or eccentric or similar mechanism acting on the side of the pivoting lever which is opposite to its pivotal mounting. With this design it is also possible to obtain an automatic return of the actuating lever member and the actuator itself. It would also be possible to have a spring connected to the actuator so that it would return to its initial position. In a bistable design and with an appropriate coupling of the respective parts, the resetting of the actuating mechanism may be obtained by an inverse rotation of the cam.

Accordingly it is an object of the invention to provide an improved switch construction in which a movable contact is movable between two stop members with at least one of them being a fixed contact and wherein a two armed swivel member is pivoted on a portion of a current carrying contact and one of its arms carries a movable contact element which is movable between the two fixed stops and which is connected by a spring member to an extension of a pivotal lever member which is pivoted over the other arm of the swivel member and wherein the lever member may be displaced by an actuator to move the spring through the plane of pivoting of the movable contact and cause it to snap into engagement in each actuating position engaged with a respective stop member or contact.

A further object of the invention is to provide a switch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWINGS

In the Drawings:

FIG. 1 is a top plan view of the inside of the housing of a switch with the cover removed and constructed in accordance with the invention;

FIG. 2 is a view similar to FIG. 1 of another embodiment of the invention.

GENERAL DESCRIPTION OF THE PREFERRED EMBODIMENTS

Referring to the drawings in particular the invention embodied therein in FIG. 1 comprises a double throw switch which includes a housing generally designated 50 having an interior switch chamber 52 in which is positioned a movable contact 1 which cooperates alternatively and selectively with one or both of two spaced apart stop members or fixed electrical contacts 2 and 3. The two fixed stop members or contacts 2 and 3 are designed as rivets and are secured in a usual manner each to an electrically conducting connection element 4 or 5 in the event that both are contacts. The third current carrying connection element 6 for a further electric lead is provided which extends into the housing and into the interior chamber 52.

In accordance with the invention the third contact element 6 has an inner end portion 7 which is engaged through a slot of a swivel member 9 so that the slot forms a pivot bearing for the swivel member. The swivel member comprises a two armed lever which is mounted for swinging movement in a direction indicated by the double arrow 8. The swivel member 9 includes arms 10 and 11 which form obtuse angles with respect to each other. A shorter first arm 11 of the swivel member carries the rear end 12 of a contact arm 13 which carries the movable contact 1. The movable contact 1 is designed as a double contact member. Ball bearings are knife edge bearings of well known design and they are secured against unintentional or undesirable disassembly. A helical tension spring 15 has one end 14 secured to the movable contact arm 13 adjacent its outer end and it is secured at its opposite end to a lateral extension 17 of a lever member or pivot lever 18. Lever member 18 is mounted by means of a knife edged bearing 19 for pivoting in the directions of the double arrow 20. The extension 17 is located adjacent the inner end of the lever member 18 and extends approximately in the direction 21 in which the switch member may be actuated by an actuator member or button 24. The inner free end of the lever 18 carries a bead 22 which applies against the free end or second arm portion 10 of the swivel member 9. Fastening points of the spring 15 are provided so that a line of action of the spring extends above a pivot joint 23 of the contact arm 13 on the swivel member first arm portion 11. Thereby the movable contact 1 is pressed against the fixed contact 3 and at the same time the pivoting lever member 18 is pressed into its knife edged bearing. In addition a firm contact between the bead 22 and the swivel member arm 10 is thereby obtained. The inner end of the pushbutton 24 is mushroom shaped and it rests against the upper side of the pivoting lever 18 opposite to the side having the bead 22. Thus the tension spring 15 also holds the actuating member in its lifted position.

Upon pushing the pushbutton 24 into the interior of the switch in the direction of the arrow 21, pivoting lever 18 and thereby also the swivel member arm 10 is pivoted in the direction of the arrow 25. At the same time the line of action of the helical tension spring 15 moves toward the bearing 23 which itself moves upwardly. As soon as the unstable position of the switch is released which occurs at the instant the line of action of the spring passes through the bearing 23, the switching mechanism reverses automatically and abruptly. Then the movable contact 1 applies against fixed contact 2. In consequence the connection element 4 and the connection element 6 are electrically connected to each other. In the first position of the switch the connection was between the connection elements 5 and 6.

In this second position of the switch the tension spring 15 produces through the contact arm 13 a torque in the swivel member 9 which acts counterclockwise so that in the absence of any actuating force all parts which were moved during the switching operation will be returned to their initial positions.

In the embodiment of the invention shown in FIG. 2 the actuator means comprises a rotary actuating cam 27 instead of a pushbutton 24. The cam 27 is rotatable about a pivot 28 in the direction of the arrow 26 and the rotation corresponds in effect to the pushing of the pushbutton 24. All other parts are of the same design as in the embodiment of FIG. 1. The pivot 28 advantageously extends through the housing to the outside where it is connected to a pivot member which may be actuated manually or mechanically. The two fixed contacts 2 and 3 also form stops for the contact arm 13.

In case the switch is used only as an on-off switch, fixed contact 2 may be replaced by a correspondingly non-conducting stop provided on the housing whereupon there is no need for the connection element 4. All parts of the switch mechanism are designed, shaped and arranged so as to obtain as rugged a construction as possible. In addition there is no difficulty in providing the switch with at least one further switching mechanism located laterally of the first mechanism and extending perpendicular to the drawing plane which for example may be switched also by means of the pushbutton 24.

While specific embodiments of the invention have been shown and described in detail to illustrate the application of the principles of the invention, it will be understood that the invention may be embodied otherwise without departing from such principles.

What is claimed is:

1. A switch comprising a housing, first and second spaced apart stop members in said housing, at least one of said stop members comprising an electrical contact, a current carrying contact arm mounted in said housing, a swivel member having a slot through which said contact arm extends and which defines a pivot bearing, and having first and second swivel arm portions on respective sides of said pivot bearing, a movable contact having an inner end pivotal on said first swivel arm portion and having an outer end disposed between and movable between said first and second stop members, a lever member overlying said second swivel arm portion and having an inner end engaged over said second swivel arm portion and an opposite outer end pivoted in said housing, a tension spring connected between said movable contact adjacent the outer end thereof and said lever member adjacent the outer end thereof so that in one position the line of action of the spring is located above the pivotal connection of said movable contact arm on said swivel member first arm portion to urge said movable contact into engagement with said first stop member and actuator means engageable with said lever arm to move said lever arm to pivot said swivel member to move said spring therewith so that its line of action moves through pivotal connection between said movable contact arm and said first swivel arm portion to move said movable contact into engagement with said second stop member, said spring acting to hold the inner end of said lever member in engagement with said swivel member.

2. A switch according to claim 1, wherein said lever member extends substantially parallel to said movable contact arm and to said second arm portion of said swivel member.

3. A switch according to claim 1, wherein said swivel member, said movable contact arm and said lever member are all pivotally mounted on knife edged bearings.

4. A switch according to claim 1, wherein said lever member has a lateral extension, said tension spring being secured to said extension, said lateral extension extending outwardly from said lever member in the switching direction.

5. A switch according to claim 1, wherein each of said stop members comprises fixed electrical contacts.

6. A switch according to claim 1, wherein said switching mechanism comprises a monostable mechanism.

7. A switch according to claim 1, wherein said actuating means comprises a pushbutton.

8. A switch according to claim 1, wherein said actuating means comprises a rotatable cam having an axis of rotation directly above said lever member and being engaged with said lever member.

9. A switch according to claim 1, wherein said actuating member is located on the side of said lever opposite to said swivel member and comprises a button slidable in said housing and having an inner end engaged on said lever member.

10. A switch according to claim 1, wherein said actuator means comprises a rotatable cam member mounted in said housing directly adjacent said lever member and having a portion in contact with said lever member.

* * * * *